United States Patent [19]

Castegnier

[11] Patent Number: 4,764,264

[45] Date of Patent: Aug. 16, 1988

[54] PRINTING METHOD BY ELECTROLYTIC COLLOID COAGULATION

[76] Inventor: Adrien Castegnier, 36 Beloeil St., Outremont, Quebec, Canada, H2V 2Z2

[21] Appl. No.: 108,694

[22] Filed: Oct. 15, 1987

Related U.S. Application Data

[63] Continuation-in-part of Ser. No. 727,259, Apr. 24, 1985, abandoned, and a continuation-in-part of Ser. No. 609,555, May 11, 1984, abandoned.

[51] Int. Cl.[4] ..... C25D 13/06

[52] U.S. Cl. ..... 204/180.9; 101/472; 204/180.2; 204/181.6; 204/299 EC

[58] Field of Search ..... 204/180.1, 180.2, 181.6, 204/180.9, 299 R, 299 PE, 299 EC, 300 R, 300 EC; 430/32, 33; 101/472

[56] References Cited

U.S. PATENT DOCUMENTS

| | | | |
|---|---|---|---|
| 2,712,695 | 7/1955 | Aller | 33/168 R |
| 3,106,155 | 10/1963 | Eastman et al. | 101/464 |
| 3,145,156 | 8/1964 | Oster | 8/444 |
| 3,455,240 | 7/1969 | Martel et al. | 430/33 |
| 3,528,206 | 9/1970 | Baird | 33/168 R |
| 3,752,746 | 8/1973 | Castegnier | 204/130 |
| 3,892,645 | 7/1975 | Castegnier | 204/180.2 |
| 4,264,422 | 4/1981 | Funabashi et al. | 204/299 EC X |
| 4,294,677 | 10/1981 | Sakagami et al. | 204/299 EC X |
| 4,331,525 | 5/1982 | Huba et al. | 204/300 EC X |
| 4,555,320 | 11/1985 | Castegnier | 204/180.9 |

FOREIGN PATENT DOCUMENTS

| | | |
|---|---|---|
| 463210 | 2/1958 | Canada . |
| 1026709 | 2/1978 | Canada . |

*Primary Examiner*—John F. Niebling
*Assistant Examiner*—William T. Leader

[57] ABSTRACT

A method of printing by electrolytic coagulation, using an improved colloid composition in association with a dyed colloid swelling agent which permits improved dye transfer from dyed coagulated images to enable very fast and accurate printing on ordinary paper. The dyed colloid swelling agent is rapidly absorbed by the coagulated colloid for dye transfer on any paper surface wetted with a paper wetting agent which is a solvent of the colloid swelling agent. The colloid is of reliable uniform quality and performance and is used in combination with a salt or acid to render the solution conductive. The colloid is selected from the group of linear synthetic colloids of high molecular weight, including polyacrylic acid and polyacrylamide resin and copolymers thereof. The swelling agent is selected from the group consisting of formamide, N-methylpyrrolidone, glycerol, sorbitol and ethylene glycol. The paper wetting agent is selected from the group consisting of acetone, methyl alcohol, ethyl alcohol and isopropylic alcohol.

11 Claims, No Drawings

PRINTING METHOD BY ELECTROLYTIC COLLOID COAGULATION

The present patent application is a continuation-in-part application of continuation-in-part patent application No. 06/727,259 filed Apr. 24, 1985, now abandoned pursuant to parent patent application Ser. No. 06/609,555, filed May 11, 1984, now abandoned.

FIELD OF THE INVENTION

This invention relates to printing and, more particularly, to a method of making a printing plate by electrolytic coagulation and printing ordinary paper with the printing plate.

DESCRIPTION OF PRIOR ART

In applicant's U.S. Pat. No. 3,892,645 dated July 1, 1975 and entitled: "PRINTING METHOD AND SYSTEM BY GELATIN COAGULATION, there is defined a method for recording an image including coagulation of a colloid composition. Electric direct current is passed at desired places through a thin layer of a liquid-state colloid composition containing an electrolyte, by means of several negative electrodes and a single positive electrolytically-inert electrode in contact with the layer, thus achieving coagulation and adherence of part of the colloid to the positive electrode and removing the non-coagulated colloid composition to leave only the coagulated image.

It has been found that the patented method may suffer adverse secondary effects and speed restrictions, making it less suitable for more-demanding applications and for achieving sustained reliable performance, such as for computer printers and photocopying. Also, the colloids used in the patented method make it impossible to print on ordinary paper, since it required gelatinized paper, which is expensive. More specifically, it has been found that the albumin or gelatin used in the above-noted patent is not usually of consistent quality due to the high variance of its molecular weight and its different chemical pretreatment, as well as its ability to be adversely affected by bacterial decomposition in ambient air.

OBJECTS OF THE INVENTION

It is the general object of the invention to obviate the above-noted disadvantages.

It is another object of the present inventon to provide a method of recording an image by electric coagulation, thus forming a printing plate, and printing ordinary paper therewith, the method achieving an increased printing speed and increased reliability suitable for computer printing and photocopying.

DESCRIPTION OF THE PREFERRED EMBODIMENTS

As in the above-noted U.S. patent, the present invention includes a method of recording an image comprising the steps of interposing a thin layer in substantially-liquid state containing water, an electrolyte and an electrolytically-coabulable colloid between and in contact with a plurality of negative electrodes, and a single positive electrode, the positive electrode being electrolytically inert, successively and selectively biasing said electrodes with direct current for a short period of time and concurrently sweeping the positive electrode by the negative electrodes to thereby cause point-by-point selective coagulation and adherence of the colloid onto said positive electrode and removing the non-coagulated colloid, whereby the coagulated colloid is representative of a desired image. The improved method is characterized by the use of a colloid selected from the group consisting of water-dispersable synthetic linear colloid polymers or copolymers, of a molecular weight between 100,000 and 600,000 and, preferably, between 200,000 and 450,000 and including polyacrylic acid and polyacrylamide resins and co-polymers thereof. The uniform characteristics of the synthetic colloids, with a well-controlled molecular weight, have been found to provide reliably-uniform and superior results over the albumin and gelatin used in the above-noted U.S. patent. The electrolyte used in the composition is either an acid or a salt selected from the group consisting of lithium, sodium, potassium and ammonium chloride. The composition also preferably includes an electrode depolarizing agent to minimize the deposition of gas against the electrodes. Such an agent is preferably selected from the group of manganese and nitrate compounds and $H_2O_2$, which combines with the gas produced against the electrodes upon breakdown of a water molecule into oxygen and hydrogen ions. Lead nitrate, manganese chloride and $H_2O_2$ have been found suitable as a depolarizing agent. The positive electrode must be electrolytically inert. Metals suitable for making the positive electrode are selected from stainless steel, aluminum and tin, with stainless steel grade 316 being preferred as giving the best results. The non-coagulated colloid composition is removed by washing or scraping the positive electrode with a soft rubber squeegee. The anode with the coagulated synthetic dots adhering thereto form the printing plate. A water solution of a dye and of a swelling agent for the coagulated dots of the printing plate is then applied to the printing plate and the coagulated dots become swollen as they absorb the solvent and absorb the dye. After removing the surplus of the dyed solution, the swelled, dyed, coagulated image is pressed in close contact with ordinary paper previously slightly wetted with an alcohol or acetone. Since the swelling agent is soluble in the alcohol, the dye of the dots is transferred onto the paper surface. Any ordinary paper can thus be printed, including uncoated paper, such as bond paper and coated paper, more specifically kaolin-coated and synthetic resin-coated paper. The preferred swelling agent is a water solution of a compound selected from the group consisting of one or more of formamide, N-methyl pyrrolidone, glycerol, ethylene glycol and sorbitol. These compounds are soluble in the alcohol used as a paper wetting agent and swells the coagulated dots much longer and much more than just water. Thus, dye transfer from the printing plate to the paper is highly efficient, fast and accurate.

Preferred alcohols for paper wetting are selected from the group consisting of methanol, ethanol and isopropylic alcohol. These alcohols possess high paper wetting property and, therefore, the colored formamide, N-methyl pyrrolidone, glycerol, ethylene glycol or sorbitol, or mixtures thereof, are absorbed by the paper fibers where they remain. Acetone can also be used for paper wetting. The dye transfer on paper just described cannot work with the gelatin and albumin colloids mentioned in the above-noted U.S. patent. Sorbitol and ethylene glycol have only a very slight swelling effect on gelatin or albumin and are totally unsatisfactory for the above-described printing step. Gelatinized paper must be used to effect printing from the printing plate where the coagulated dots are gelatin or albumin.

EXAMPLE 1

The following electrolytically-coabulable colloid composition was prepared:

| | | PERCENT BY WEIGHT |
|---|---|---|
| Polyacrylic acid (Carbopol 907 of B. F. Goodrich) molecular weight 450,000: | 10 grams | 8.77 |
| KCL electrolyte | 4 grams | 3.51 |
| water | 100 grams | 87.72 |
| | 114 grams | 100.00 |

This water solution has a pH of 2.25. This solution was used as a layer between the negative and positive electrodes in the above-described method for recording an image. The positive electrode was stainless steel grade 316. The gap between the negative and positive electrodes was 50 microns. The negative electrodes were copper-insulated wires of 250 microns in diameter arranged in a linear array. The electrodes were successively biased by successively and selectively applying to the negative electrodes a power supply of 25 watts (50 volts and 500 milliamperes). The operating temperature was 30° C. A speed of coagulation of 300,000 dots per second was achieved, with the size of the dots being 250 microns in diameter. This means that an electric pulse at each electrode of one-three hundred thousandths of a second was necessary to effect coagulation.

The experiment was repeated several times and the coagulation results were very constant from one experiment to the other. Additional experiments were repeated using the same liquid composition but using negative electrodes having a diameter of 125 microns instead of 250 microns. The resulting speed of coagulation was found to be 1,000,000 dots per second, that is requiring an electrical pulse for each negative electrode of one millionth of a second.

Comparative experiments were made using the same set-up but with gelatin and albumin as the colloid. The coagulation was very inconsistent from one experiment to the other, and the speed of coagulation using 250 microns negative electrodes was only 100,000 dots per second.

EXAMPLE II

A series of experiments were conducted for recording an image using the same electrolytically-coagulable colloid composition, but with the polyacrylic acid mentioned in Example I replaced by a polyacrylic acid of molecular weight of 250,000 as supplied by Aldrich under code number 18128-5, with the resulting solution having a pH adjusted to 2.30. Very similar results were obtained: other experiments were carried out and with similar results using the following colloid polymer: Polyacrylamide of molecular weight 200,000, supplied by Aldrich under code number 19-092-6, with the solution adjusted to a pH of 4.46.

Additional experiments were carried out with the same results, using a copolymer of polyacrylamide and of polyacrylic acid of molecular weight 250,000, as supplied by Cyanamid under code name ACCOSTRENGTH 86, with the solution adjusted to pH 4.63.

EXAMPLE III

Experiments similar to those of the prior-mentioned examples were carried out, but while varying the voltage or the pulse duration applied to the electrodes; it was found that the size or thickness of the coagulated dots varied in proportion to the applied voltage or pulse duration, thus permitting the reproduction of half-tones.

EXAMPLE IV

To the liquid electrolytically-coagulable colloid composition of any of the above noted examples, was added a depolarizing agent consisting of two percent by weight of a compound selected from lead nitrate, manganese chloride and $H_2O_2$, with even better results.

EXAMPLE V

The coagulated synthetic resin dots of the printing plate obtained from any of the foregoing examples were swollen and colored by applying thereto the following solution:

| | | PERCENT BY WEIGHT |
|---|---|---|
| water soluble dye selected from Pina dyes and obtained from RIDEL-deHAEN (West Germany) | 5 grams | 3.84 |
| glycerol 20 c.c. or | 25.2 grams | 19.35 |
| water | 100 grams | 76.81 |
| | 130.2 grams | 100.00 |

The coagulated dots became quickly and highly swollen and absorbed the dye. The surplus dye solution was then removed and the swelled, dyed coagulated image was pressed in close contact with a kaolin-coated paper previously wetted with methanol. The methanol, which is a solvent for glycerol, caused the transfer of the dye to the paper surface, resulting in the image transfer to the paper. About seven paper sheets were thus printed with the same printing plate, while recharging the synthetic dots with the dye and swelling agent each time; it was found that up to about seven sheets could be printed. To print additional sheets, it was necessary to remake the printing plate.

Each time a paper sheet was printed, there was not only a dye transfer but also a transfer of a portion of the coagulated dots. Very precise and clear images were obtained on the paper sheets.

EXAMPLE VI

The same experiments were carried out as in Example V, but while using the following coloring and swelling composition:

| | | PERCENTAGE BY WEIGHT |
|---|---|---|
| dye Pina from RIEDEL-deHAEN (West Germany) | 5 grams | 3.61 |
| ethylene glycol 30 c.c or | 33.46 grams | 24.17 |
| water | 100 grams | 72.22 |
| | 138.46 grams | 100.00 |

The paper wetting agent was ethanol and similar results as in Example V were obtained.

EXAMPLE VII

The same experiments as Example V were carried out but using the following coloring and swelling agent composition for treating the coagulated dots of the printing plate image:

| | | PERCENT BY WEIGHT |
|---|---|---|
| water-soluble dye, a Pina dye from RIEDEL-deHAEN | 5 grams | 3.23 |
| sorbitol | 50 grams | 32.25 |
| water | 100 grams | 64.52 |
| | 155 grams | 100.00 |

Isopropylic alcohol was used as the paper wetting agent. The dye transfer to the paper was less than in Examples V and VI, since sorbitol is a poorer solvent and, therefore, a poorer swelling agent than glycerol or ethylene glycol for the coagulated dots of the colloids named in Examples I to IV. However, it was found that, when sorbitol is admixed with either or both glycerol and ethylene glycol, the coagulated colloid swelling efficiency can be adjusted for maximum dye transfer to the paper.

EXAMPLE VIII

The same experiments were carried out as in Example V, but while using the following coloring and swelling agent:

| – | PERCENT BY WEIGHT |
|---|---|
| dye: Pina blue from RIEDEL-deHAEN | 5% |
| ethylene glycol | 20% |
| formamide | 20% |
| water | 55% |

The paper wetting agent was acetone instead of methanol. Dye transfer during printing was more accurate than in Example IV.

EXAMPLE IX

The same experiments were carried out in Example V, but while using the following coloring and swelling composition:

| | PERCENT BY WEIGHT |
|---|---|
| water soluble dye Pina blue from RIEDEL-deHAEN | 5% |
| N—methyl pyrrolidone | 20% |
| water | 75% |

The paper wetting agent was acetone in one set of experiments and isopropylic alcohol in the other set.

Dye transfer was even more accurate than in Example VIII during printing.

EXAMPLE X

The same experiments as in Examples V to IX were carried out, but the printing step was carried out on bond paper. This necessitated heating the printed sheet by hot-blown air to accelerate its drying, in order to prevent spreading of the dye through the paper fibers.

EXAMPLE XI

Experiments were carried out in accordance with Examples I, II and IV, while varying the voltage applied to the electrodes, followed by paper printing in accordance with Examples V to X, and the printed image exhibited the 64 grades of half-tones as required for image printing in photographic work.

EXAMPLE XII

The same experiments with the same results were carried out as in Example XI but while varying the duration of the applied voltage instead of varying the voltage.

I claim:

1. A method of recording an image and forming a printing plate and then printing the image on an end-use paper support, comprising the steps of interposing a thin layer in substantially liquid-state, containing water, an electrolyte and an electrolytically-coagulable colloid between and in contact with a plurality of negative electrodes disposed side by side and a single positive, electrolytically-inert electrode, successively and selectively electrically, negatively biasing said negative electrodes relative to said positive electrode with direct current for a short period of time, to thereby cause point-by-point selective coagulation and adherence of the resulting coagulated colloid dots onto said positive electrode, removing the non-coagulated colloid, whereby the coagulated dots are representative of a desired image, said positive electrode with the coagulated dots adhering thereto, forming said printing plate, impregnating said dots with an impregnating water solution of a coagulated colloid swelling agent and of a water soluble dye to cause swelling of and dye absorption by said dots, wetting an end-use paper sheet with a paper wetting agent which is a solvent for the swelling agent, pressing said printing plate against said wetted end-use paper support to transfer the dyed image onto the latter, and drying said paper support, the colloid being selected from the group consisting of water dispersable synthetic linear colloid polymers of molecular weight between 100,000 and 600,000, said swelling agent being selected from the group consisting of glycerol, ethylene glycol, sorbitol, formamide and N-methyl pyrrolidone.

2. A method as defined in claim 1, wherein said colloid is selected from the group consisting of polyacrylic acids and polyacrylamides and copolymers thereof, and having a molecular weight of between 200,000 and 450,000.

3. A method as defined in claim 1, wherein said colloid is a copolymer of polyacrylamide and of polyacrylic acid of a molecular weight of 250,000.

4. A method as defined in claim 2, wherein the amount of said colloid in said layer is between 6% and 12% by weight and the amount of electrolyte is sufficient to obtain a layer having a pH lying between 2.25 and 5.

5. A method as defined in claim 4, wherein said impregnating solution includes between 3% and 5% by weight of said dye and between 19% and 40% by weight of said swelling agent.

6. A method as defined in claim 2, wherein said paper wetting agent is selected from the group consisting of acetone, methanol, ethanol and isopropylic alcohol.

7. A method as defined in claim 2, wherein the electrolyte is selected from the group consisting of lithium, sodium and potassium chlorides and of ammonium chloride.

8. A method as defined in claim 2, wherein the positive electrode is made of a metal selected from the group consisting of aluminum, tin and stainless steel.

9. A method as defined in claim 8, wherein the positive electrode is made of stainless steel, grade 316.

10. A method as defined in claim 8, wherein a variable voltage is applied across said negative and positive electrodes to vary the amount of coagulated colloid forming the dots.

11. A method as defined in claim 8, wherein the duration of the voltage bias applied across said negative and positive electrodes is controlled to vary the amount of coagulated colloid forming the dots.

* * * * *